US005979133A

United States Patent [19]

Funkhouser

[11] Patent Number: 5,979,133

[45] Date of Patent: Nov. 9, 1999

[54] REINFORCED WATERPROOFING SYSTEM FOR POROUS DECKS

[76] Inventor: Philip L. Funkhouser, 14717 S. 53rd East Ave., Bixby, Okla. 74008

[21] Appl. No.: 08/896,812

[22] Filed: Jul. 18, 1997

[51] Int. Cl.[6] ..... E04B 7/00; E04B 1/62

[52] U.S. Cl. ..... 52/408; 52/515; 52/518; 52/454; 428/353; 428/354; 428/355 EP

[58] Field of Search ..... 52/408–410, 515, 52/518, 454; 428/49, 344, 354, 355 EP, 921, 353

[56] References Cited

U.S. PATENT DOCUMENTS

| | | | |
|---|---|---|---|
| 4,349,398 | 9/1982 | Kearns et al. | 156/71 |
| 4,393,634 | 7/1983 | McDermott et al. | 52/309.1 |
| 4,558,550 | 12/1985 | Marchais et al. | 52/309.7 |
| 4,609,305 | 9/1986 | Groeneveld | 405/195 |
| 4,633,633 | 1/1987 | Bard | 52/384 |
| 4,783,942 | 11/1988 | Nunley et al. | 52/309.1 |
| 4,848,057 | 7/1989 | MacDonald et al. | 52/518 |
| 4,870,796 | 10/1989 | Nart et al. | 52/409 |
| 5,088,259 | 2/1992 | Myers | 52/410 |
| 5,283,998 | 2/1994 | Jong | 52/515 |

*Primary Examiner*—Christopher T. Kent
*Assistant Examiner*—Yvonne Horton-Richardson
*Attorney, Agent, or Firm*—Wood, Herron & Evans, LLP

[57] ABSTRACT

A composite reinforced roof is formed by applying to a roof deck a preformed membrane which has a tacky lower layer formed from rubberized asphalt. The second layer of the preformed membrane is a reinforcing mesh material embedded in the surface of the rubberized asphalt. This is applied to a roof deck and subsequently overcoated with a molten coating of rubberized asphalt. The self-adherent rubberized asphalt membrane prevents formation of bubbles and pinholes in the molten rubberized asphalt layer. This is particularly beneficial when the roof deck surface is lightweight structural concrete which releases gas when heated.

11 Claims, 1 Drawing Sheet

REINFORCED WATERPROOFING SYSTEM FOR POROUS DECKS

BACKGROUND OF THE INVENTION

There are a number of different roof systems used to protect commercial buildings. These can include membrane roofs which are good for particularly large, uninterrupted surfaces, and composite or built-up roofs. Composite or built-up roofs are particularly useful to cover roof surfaces requiring a significant amount of detail work.

Originally, built-up roofs were simply a layer of tar paper overcoated with a layer of tar and ballast. More recently, reinforced rubberized asphalt composite roofing has been employed. This roofing system generally includes primer, then a first layer of molten rubberized asphalt applied onto a roof deck. A fabric, typically non-woven polyester, is then laid over the initial layer of molten rubberized asphalt. This is overcoated with a second layer of rubberized asphalt. Rubberized asphalt itself is a blend of asphalt and thermoplastic polymer. This remains flexible even at low temperatures, i.e., −20° F. Further, it exhibits better elongation than asphalt.

Built up waterproofing systems are relatively labor-intensive. The application of two coatings of rubberized asphalt and the proper placement of the reinforcing mesh significantly increases labor costs.

This system is also difficult to apply to surfaces with high air or moisture contents. For example, lightweight structural concrete surfaces do not accept this asphalt coating particularly well. Either the first or the second layer can form pockets or bubbles and pinholes can also form.

SUMMARY OF THE INVENTION

The present invention is premised on the realization that a reinforced rubberized asphalt built-up waterproofing system can be formed, even on a lightweight structural concrete surface, by applying as the first layer a preformed rubberized asphalt sheet. The preformed sheet has a lower layer of tacky rubberized asphalt and an upper layer is the reinforced mesh embedded in the first layer. This is applied to the surface such as a roof and pressed against the surface causing the rubberized asphalt layer to adhere to the surface at ambient temperature. Subsequently, a protective layer such as a molten layer of rubberized asphalt is applied over the preformed sheet.

When this molten rubberized asphalt layer is applied to the preformed layer already adhered to the surface, it does not develop pockets or bubbles, nor does it develop pin holes in either the outer rubberized asphalt layer or the inner layer. It remains tacky and flexible. Further, this requires significantly less labor than prior rubberized asphalt roof surfaces.

Thus, the present invention provides a method to coat even lightweight structural concrete surfaces with a built-up reinforced rubberized asphalt surface.

The objects and advantages of the present invention will be further appreciated in light of the following detailed descriptions and drawing in which:

DETAILED DESCRIPTION

The present invention is a waterproofing system for horizontal surfaces. The application generally refers to these horizontal surfaces as roofs. This term is intended to include plaza decks and other horizontal surfaces which cover usable space. However, for simplicity these horizontal surfaces are simply referred to as roofs.

Figure 1:
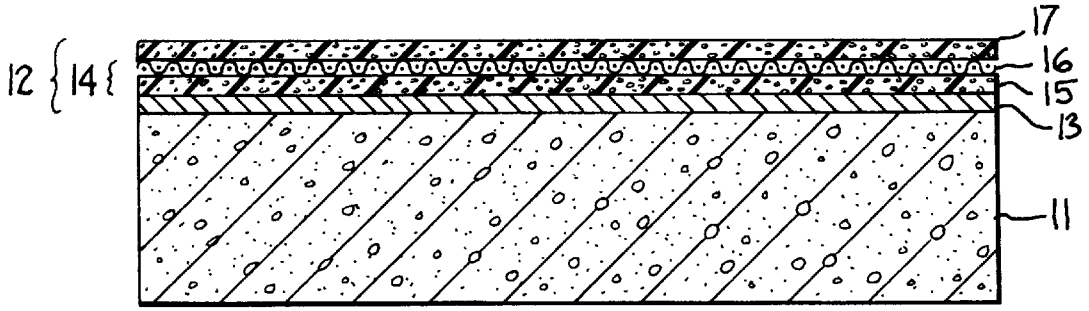
FIG. 1 is a cross-section of a roof surface broken away.

As shown in FIG. 1, a deck 11 such as a roof deck is covered with a built-up rubberized asphalt waterproofing system 12. This built-up waterproofing system 12 includes an initial primer layer 13 applied to the surface of roof deck 11. This is then covered with a membrane 14. Membrane 14 is a pre-formed membrane that has a uniform self-adherent rubberized asphaltic layer 15 and an upper reinforcing mesh layer 16 partially embedded in layer 15. The opposite side of layer 15 adheres to primer layer 13 and thus to the roof deck. The upper reinforcing mesh layer 16 of membrane 14 is then coated with a final layer of molten rubberized asphalt 17. This can then be covered with a variety of final protective layers 18.

The roof deck can be any solid roof deck such as concrete, metal and lightweight structural concrete. The present invention is particularly suitable for use with lightweight structural concrete. This concrete has air trapped in its structure which reduces the weight of the concrete without significantly reducing its strength.

The rubberized asphalt membrane 14 is formed from a layer 15 of adherent tacky rubberized asphalt. Adherent indicates that the layer 15 at room temperature, i.e., from about 32° F. up to about 140° F., is tacky and will adhere to the roof structure at that temperature without application of additional heat or use of other adhesives. The rubberized asphalt sheeting is simply formed by heating rubberized asphalt and extruding or calendaring the rubberized asphalt into a sheet. Generally, the thickness of this rubberized asphalt layer should be from about 60 to about 120 mils. Rubberized asphalt generally is formed from the following:

| | % Weight |
|---|---|
| Bituminous Materials | |
| Asphalts | 65–85 |
| Tackifiers | |
| Oils | |
| Reinforcing Filler | |
| Calcium Carbonate | 15–5 |
| Magnesium Silicate | |
| Mica | |
| Thermoplastic polymers | |
| Styrene-Butadiene-Styrene (SBS) | 20–10 |
| Styrene-Isoprene-Styrene (SIS) | |
| Styrene-Ethylene-Butadiene-Styrene (SEBS) | |
| Styrene-Butadiene (SBR) | |
| Polyvinyl Chloride (PVC) | |
| Butyl | |
| Neoprene | |

The mesh material 16 is simply compressed into the surface of this rubberized asphalt layer 15. The mesh material 16 can be either woven or nonwoven. This reinforcing layer can vary, depending upon required strength. A woven polypropylene mesh is particularly suitable in the present invention. This fabric must have a melting point higher than about 300° F. and preferably has a melting point of at least about 330° F. Any fabric which adheres to the rubberized asphalt and has adequate strength will function in the present invention. Generally, the strength should be at least 30 lbs/in$^2$, preferably 50 or higher.

When this sheeting is formed, a silicone-treated separation sheet is generally used to prevent the rubberized asphalt layer from adhering to itself and to permit the sheeting to be formed into a roll for shipment. Reinforced rubberized asphalt sheeting such as membrane 14 is typically used as an underlayment for asphalt road surfaces. Such rubberized sheeting can be purchased from a variety of different sources. Suitable sources include Carlisle, Amoco, and W. R. Grace.

The outer sealant rubberized asphalt layer is basically the same material as the rubberized asphalt layer of membrane 14. However, other materials can be used on the outer layer in lieu of the rubberized asphalt. These include tacky butyl rubber, as well as a thermoplastic polyurethane coating. This layer will generally have an applied thickness of 60 to 120 mils.

The roof structure of the present invention is applied to a roof deck surface 12 by cleaning and drying the surface. The surface should have a smooth finish and be free of all voids, sharp protrusions and loose aggregate. Application temperature is preferably at or above 40° F.

After all terminations, joints and cracks are properly prepared with flashing, a priming layer is applied. Particularly suitable for the roof surface, a concrete primer would be generally applied for a concrete deck. The primer can be a polymer such as tackifying resin, SBS, SIS, asphalt or a blend thereof dispersed in a solvent with a solids content of about 25 to 50% by weight. This is allowed to dry and membrane 14 is placed over the roof surface.

Next, membrane 14 is applied by laying it onto the primed roof deck surface with the rubberized asphalt layer 15 placed against the primed roof surface. Adjoining sheets are overlapped at least 2-½ inches. The tacky rubberized asphalt layer 15 will adhere directly to the primed deck surface without the need to apply any other adhesive as a fastener.

To improve adhesion, the membrane 14 is rolled with a metal roller and wrapped with a resilient material. Preferably, the roller should be 18–24 inches wide and weigh at least 100 pounds. All terminating edges and T-joints are then sealed.

Next, the outer sealant layer 17, preferably rubberized asphalt, is applied over the mesh surface. This rubberized asphalt is heated until molten, i.e. 275° to 350° F., and poured onto the mesh layer 16 of membrane 14 and spread evenly over the surface. Once applied, the rubberized asphalt is allowed to cool and solidify.

Figure 2:
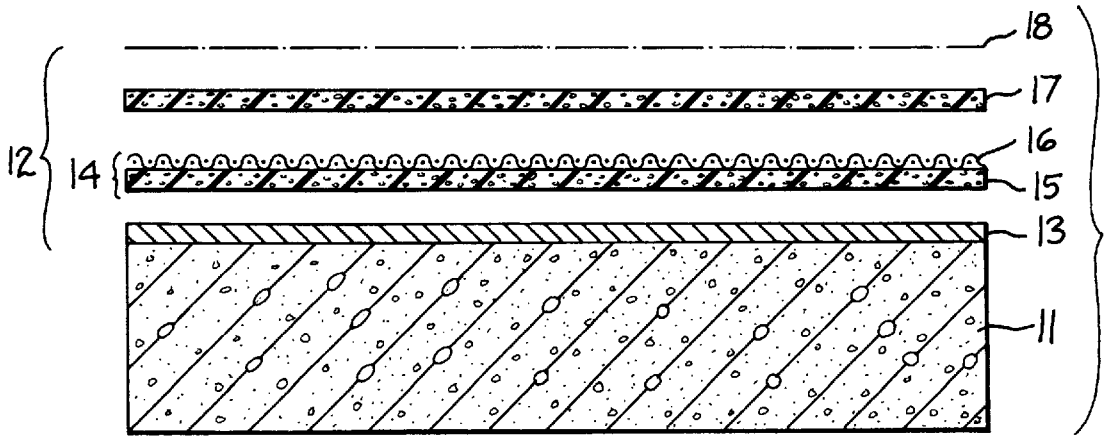
FIG. 2 is a blown up view of the roof structure shown in FIG. 1.

This can then be covered with one of several additional layers diagrammatically represented as layer 18 in FIG. 2. Asphaltic board can be applied over layer 16, as well as insulation, if desired. A drainage composite can also be applied, but again is optional. Finally, poured concrete, concrete pads or papers, or ballast can be applied. If desired, even dirt can be placed over layer 18 and grass grown on the dirt. This final layer protects asphalt layer 17 from sun, provides ballast, and may serve a variety of different purposes, depending on the intended use of the roof deck.

This method of coating a roof structure overcomes the problem of blistering and pinhole formation typically encountered, particularly with respect to structural lightweight concrete surfaces. The present method eliminates the problem of bubble formation and pinhole formation. Further, this method significantly increases the application efficiency, reducing the overall amount of labor required. Thus, the present invention provides many different advantages.

This has been a description of the present invention and the best mode of practicing this invention currently known to the inventor.

However, the invention itself should be defined by the appended claims wherein I claim:

1. A roof structure comprising:

a roof deck;

a membrane having a first layer adhered to said deck and a second layer facing away from said deck;

said first layer comprising a preformed uniform self-adherent tacky rubberized asphalt;

said second layer comprising a reinforcing mesh partially embedded in said first layer;

a third layer covering and adherent to said second layer, said third layer comprising a sealing layer selected from the group consisting of rubberized asphalt, tacky butyl rubber and polyurethane, wherein said roof deck is lightweight structural concrete.

2. The roof structure claimed in claim 1 comprising a primer layer coating said roof deck wherein said first layer is adhered to said primer layer.

3. The roof structure claimed in claim 1 wherein said first layer is from 60 to 120 mils. thick.

4. The roof structure claimed in claim 3 wherein said first layer is rubberized asphalt.

5. The roof structure claimed in claim 4 wherein said second layer has a strength of at least 30 lbs/in$^2$.

6. The roof structure claimed in claim 5 wherein said second layer comprises a polymeric mesh web.

7. The roof structure claimed in claim 6 wherein said polymeric mesh web is nonwoven polypropylene.

8. The roof structure claimed in claim 1 wherein said sealant layer is covered with an outer protective layer.

9. A method of waterproofing a horizontal surface comprising applying onto said surface a preformed composite membrane, said membrane having a first layer and a second layer, said first layer comprising rubberized asphalt which is tacky at 40° F., said second layer comprising a mesh partially embedded in said first layer, wherein said first layer is applied against said surface and adheres to said surface;

coating said second layer with a layer of molten sealant and allowing said molten sealant layer to at least partially solidify.

10. The method claimed in claim 9 further comprising applying a primer layer to said surface prior to applying said membrane.

11. The method claimed in claim 9 wherein said molten sealant layer is selected from the group consisting of rubberized asphalt, butyl rubber and polyurethane.

* * * * *